US006298802B1

(12) United States Patent
Brignolio

(10) Patent No.: US 6,298,802 B1
(45) Date of Patent: Oct. 9, 2001

(54) COLLAPSIBLE BOAT TRANSPORT APPARATUS

(76) Inventor: James C. Brignolio, 14755 S. Prescott Rd., Manteca, CA (US) 95336

( * ) Notice: Subject to any disclaimer, the term of this patent is extended or adjusted under 35 U.S.C. 154(b) by 0 days.

(21) Appl. No.: 09/495,462

(22) Filed: Feb. 1, 2000

Related U.S. Application Data

(63) Continuation-in-part of application No. 09/343,331, filed on Jun. 30, 1999.

(51) Int. Cl.[7] ..... B60P 3/10

(52) U.S. Cl. ..... 114/344; 114/353; 114/354; 114/61.18

(58) Field of Search ..... 14/2.4, 2.6, 27; 114/344, 353, 354, 61.15, 61.18, 45; 280/414.1, 414.2

(56) References Cited

U.S. PATENT DOCUMENTS

| | | |
|---|---|---|
| 2,876,728 | 3/1959 | Luger . |
| 2,992,444 | 7/1961 | Schuler . |
| 3,925,837 | 12/1975 | Miller . |
| 3,978,536 | 9/1976 | Howe . |
| 4,909,169 | 3/1990 | Skandaliaris et al. . |

*Primary Examiner*—S. Joseph Morano
*Assistant Examiner*—Ajay Vasudeva
(74) *Attorney, Agent, or Firm*—Thomas R. Lampe

(57) ABSTRACT

A collapsible boat including pontoons is positioned on a trailer or other transport vehicle having supports for the pontoons. The pontoon supports are movable toward or away from each other. Pontoons supported by the pontoon supports will move along with the pontoon supports to either collapse or expand the boat.

21 Claims, 4 Drawing Sheets

COLLAPSIBLE BOAT TRANSPORT APPARATUS

COLLAPSIBLE BOAT TRANSPORT APPARATUS

This application is a continuation-in-part of my co-pending U.S. application Ser. No. 09/343,331, filed Jun. 30, 1999.

TECHNICAL FIELD

This invention relates to a collapsible boat and a transport vehicle for transporting the collapsible boat. More particularly, the collapsible boat incorporates pontoons and the transport vehicle includes supports for the pontoons which are employed to move the collapsible boat between a wide boat configuration and a narrow boat configuration.

BACKGROUND OF THE INVENTION

The following United States patents disclose boat structures which can be collapsed to provide an alternate boat configuration: U.S. Pat. No. 3,925,837, issued Dec. 16, 1975, U.S. Pat. No. 2,876,728, issued Mar. 10, 1959, U.S. Pat. No. 4,909,169, issued Mar. 20, 1990, U.S. Pat. No. 3,978,536, issued Sep. 7, 1976, and U.S. Pat. No. 2,992,444, issued Jul. 18, 1.961. These patents are believed to be representative of the current stage of the prior art and they fail to provide any teaching of the combination of the structural elements disclosed and claimed herein.

My U.S. patent application Ser. No. 09/343,331, filed Jun. 30, 1999, discloses a collapsible boat structure in the form of a pontoon boat which incorporates a plurality of boat deck panels, including first and Second center deck panels which move from a substantially horizontal orientation to a substantially vertical orientation during collapse of the boat. The boat incorporates structure utilized to narrow or widen the boat as desired.

DISCLOSURE OF INVENTION

The invention disclosed and claimed herein includes a collapsible boat having a plurality of boat deck panels similar in construction to the boat deck panels shown in my prior application. However, in accordance with the teachings of the present invention, a transport vehicle for the boat, rather than the collapsible boat itself, incorporates structure for changing the configuration of the collapsible boat. This occurs when the collapsible boat is positioned on the transport vehicle. Such an approach is advantageous in that the structure employed to collapse the boat is not subjected to water exposure when the boat is on the surface of the body of water. Furthermore, decrease in the boat width while the boat is afloat could, under certain circumstances, adversely affect boat stability.

The collapsible boat disclosed and claimed herein has a first and a second configuration, the collapsible boat being wider in the first configuration than when it is in the second configuration.

A transport vehicle, such as a trailer, is employed to support and transport the collapsible boat, the transport vehicle including boat collapsing means engageable with the collapsible boat to change the configuration of the collapsible boat from the first configuration to the second configuration while the transport vehicle supports the collapsible boat.

The collapsible boat includes first and second pontoons and the boat collapsing means includes first and second pontoon supports for respectively accommodating the first and second pontoons and pontoon support mover means for moving the pontoon supports and any pontoons accommodated thereby toward one another.

Other features, advantages, and objects of the present invention will become apparent with reference to the following description and accompanying drawings.

BEST MODE FOR CARRYING OUT THE INVENTION

Figure 1:
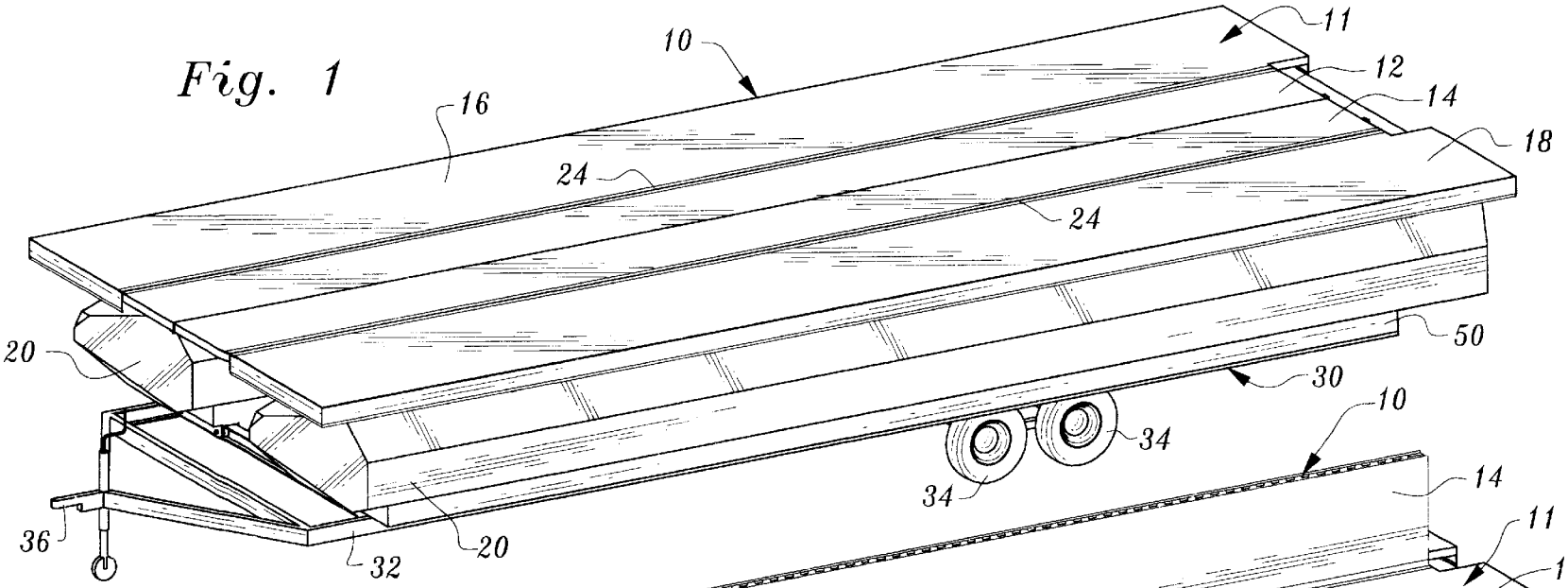
FIG. 1 is a perspective view of a collapsible boat supported by a transport vehicle constructed in accordance with the teachings of the present invention, the collapsible boat being shown in the non-collapsed condition.

Referring now to the drawings, a collapsible boat 10 is illustrated, the boat being similar in construction to that shown in my co-pending U.S. patent application Ser. No. 09/343,331, filed Jun. 30, 1999.

Figure 2:
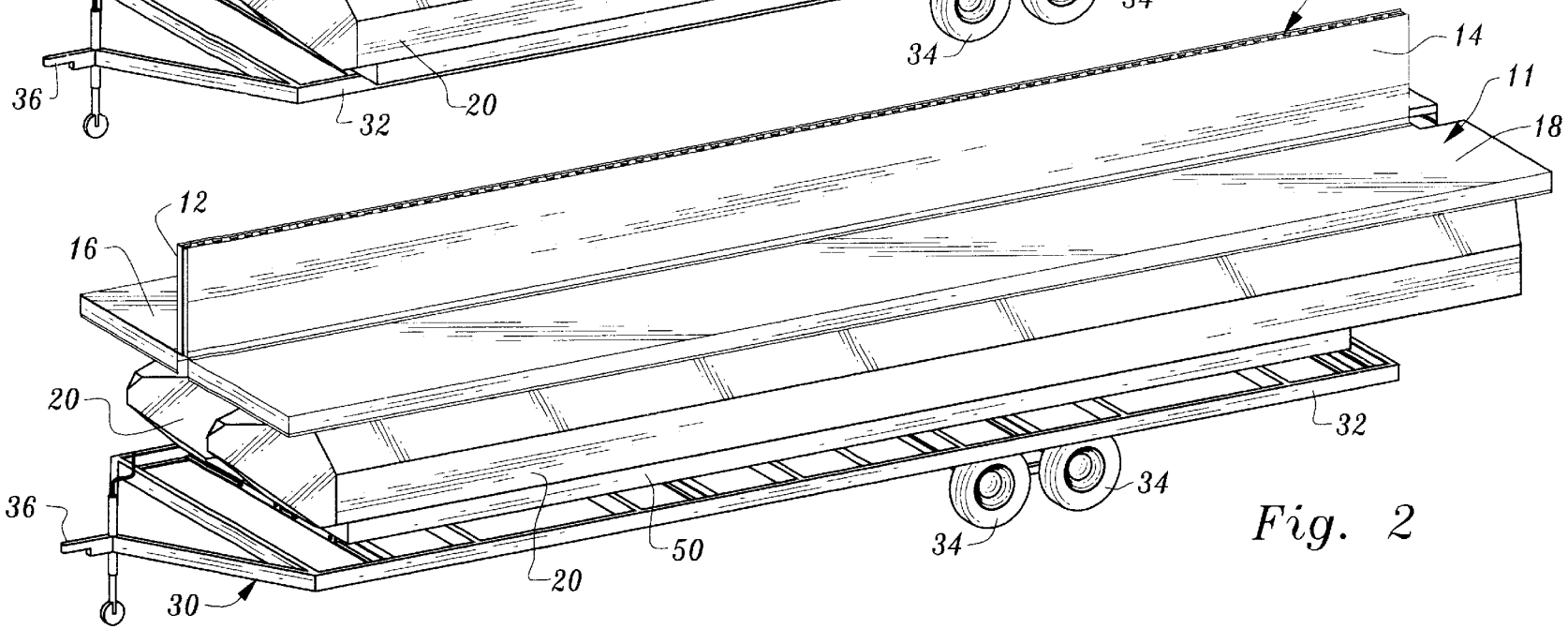
FIG. 2 is a view similar to FIG. 1 but illustrating the boat in collapsed condition on the transport vehicle, the boat having a reduced width in the collapsed condition.
Figure 3:
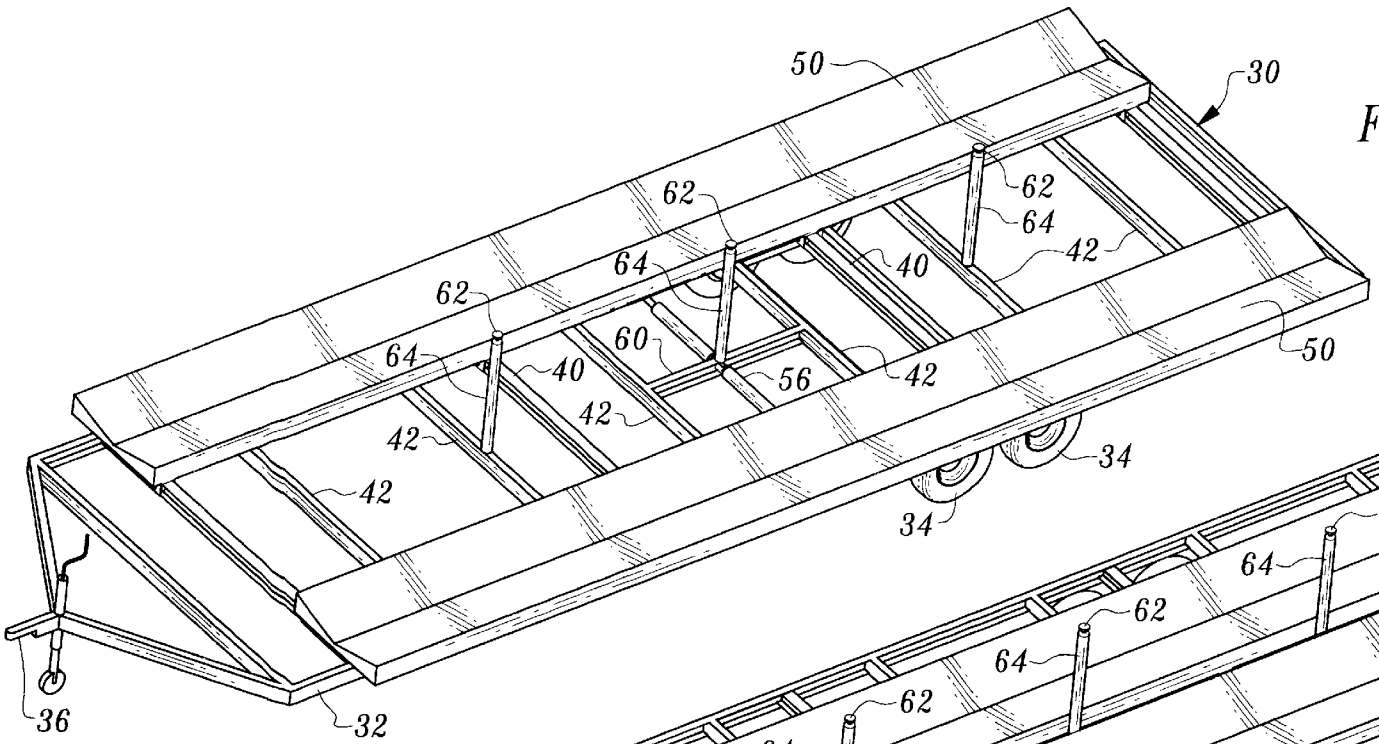
FIG. 3 is a perspective view of the transport vehicle with the collapsible boat removed therefrom and pontoon supports of the transport vehicle being shown in a spaced apart condition.
Figure 5:
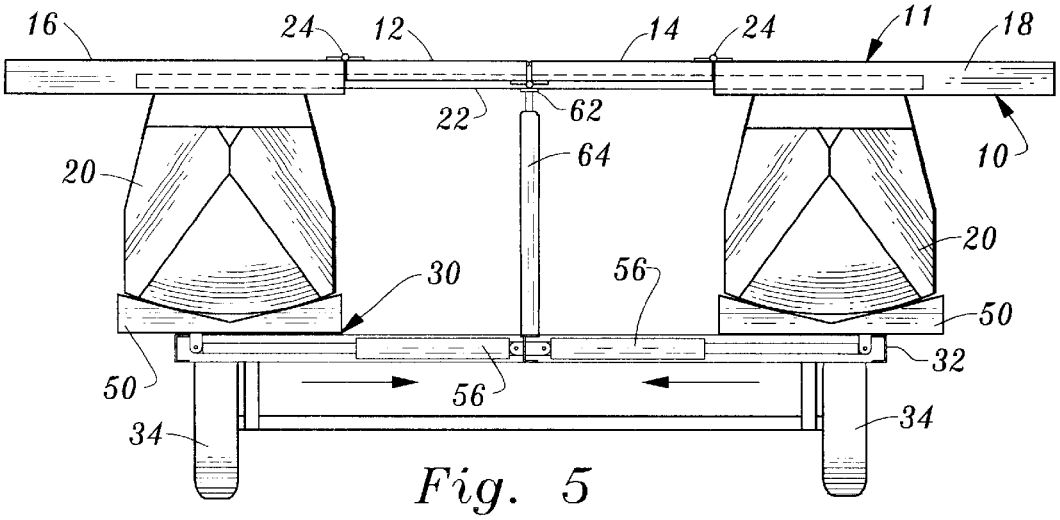
FIG. 5 is a front elevational view of the transport vehicle and collapsible boat supported thereby, the pontoons and boat deck panels being shown in the respective positions assumed thereby when the collapsible boat is in the wide or non-collapsed condition.
Figure 6:
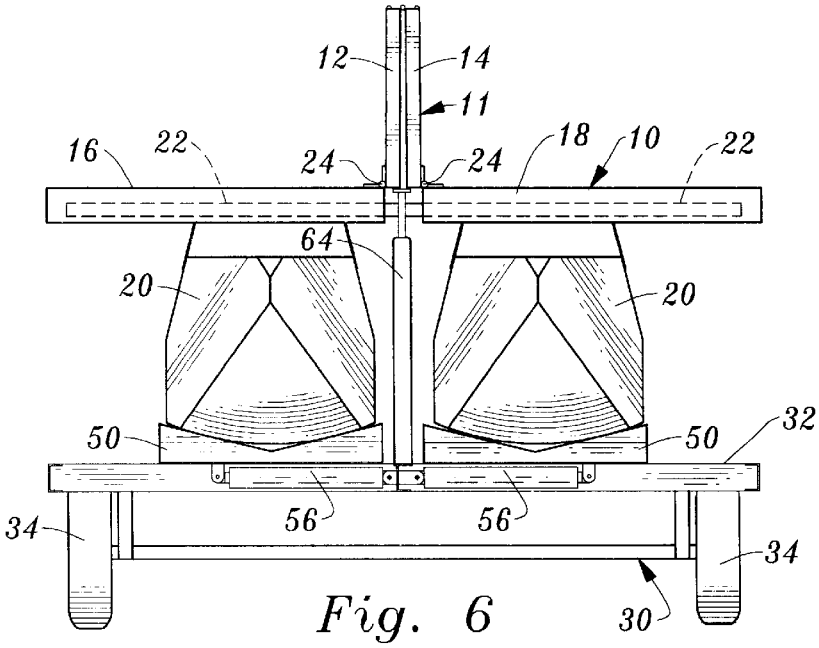
FIG. 6 is a view similar to view 5 but showing the boat in collapsed condition, the pontoons and pontoon supports being in close proximity.

Boat 10 has first and second alternative configurations, the boat being wider in the first configuration thereof (shown in FIGS. 1 and 5, for example) than in the second configuration thereof (shown in FIGS. 2 and 6, for example).

The boat 10 includes a boat deck 11 having center deck panels 12, 14 disposed side-by-side and outer deck panels 16, 18. Outer deck panel 16 is disposed alongside center deck panel 12, the center deck panel 12 located between the center deck panel 14 and outer deck panel 16. Outer deck panel 18 is disposed alongside the center deck panel 14, the center deck panel 14 positioned between the center deck panel 12 and the outer deck panel 18.

When the boat is in non-collapsed condition for use as a boat, the panels 12, 14, 16 and 18 are all oriented horizontally and are in the same plane. The can be seen in FIG. 1, for example. When, however, the boat is to be collapsed for storage or transport, the center deck panels are moved from a horizontal orientation to a vertical orientation as shown in FIG. 2, for example.

Pontoons 20 are connected to and extend from the bottoms of the outer deck panels 16, 18. The outer deck panels move toward one another when the center deck panels move to a vertical orientation, the pontoons 20 moving along with the outer deck panels.

The outer deck panels 16, 18 are slidably, movably mounted on a framework 22 (FIGS. 5 and 6), the center deck panels being supported on the center portion of the framework when in their horizontal orientations as shown in FIG. 5, for example. Hinges 24 provide a pivotal interconnection between the center deck panel 12 and outer deck panel 16 and between center deck panel 14 and outer deck panel 18, allowing pivotal movement between the center deck panels and outer deck panels to occur as the boat is expanded or collapsed.

The collapsible boat is supported and transported by a transport vehicle in the form of a trailer 30 including a trailer frame 32 supported by wheels 34. A hitch 36 projects from the front of the trailer.

Figures 9, 10, 11:
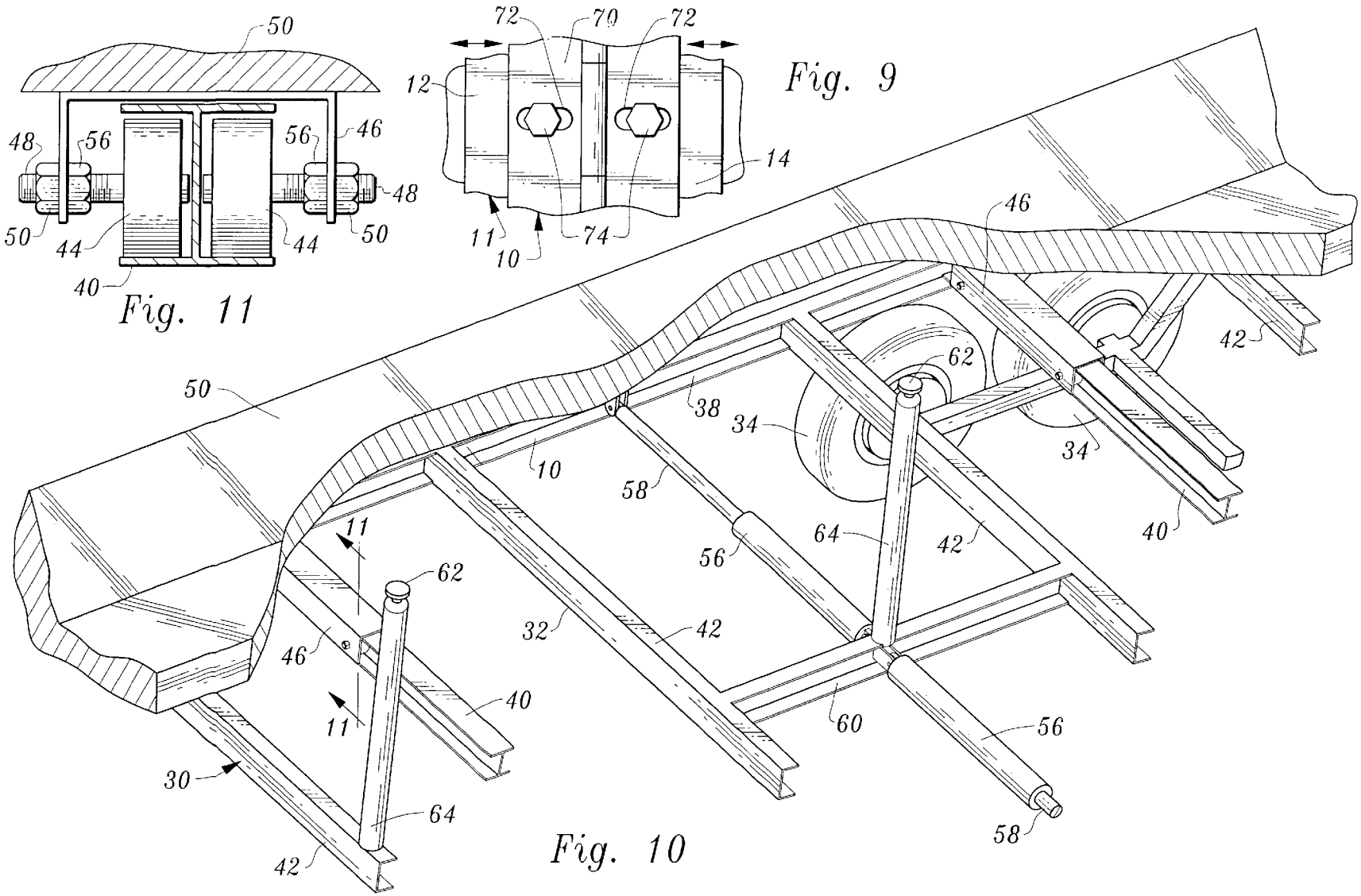
FIG. 9 is an enlarged bottom view of hinge structure interconnecting the center deck panels.
FIG. 10 is a top perspective view illustrating broken away portions of selected components of the transport vehicle.
FIG. 11 is an enlarged, cross-sectional view taken along the line 11—11 in FIG. 10.

Frame 32 includes two spaced side rails 38, one of which is shown in FIG. 10, and cross channels 40, 42 extending between the side rails. Cross channels 40 are I-beams and they accommodate pairs of rollers 44 (see FIG. 11) which are rotatably journaled on an elongated bracket 46. The rollers are connected to bracket 46 by threaded shafts 48. Nuts 50 are employed to adjust the positioning of the rollers 44 relative to the associated cross channels 40. The elongated bracket members are considerably shorter than the cross channels 40 with which they are associated. In the interest of simplicity, FIG. 10 only shows the elongated bracket members 46 disposed at one of the sides of the trailer, although they are in fact located at both sides.

Pontoon supports 50 extend along the length of the trailer frame and are affixed to and supported by pairs of bracket members 46. The upper surfaces of the pontoon supports have a trough-like configuration and are sized to receive the bottoms of pontoon 20 of collapsible boat 10.

Pneumatic or hydraulic cylinders 56 are deployed between the ends of the trailer frame, the movable shafts 58 thereof secured to the pontoon supports. The inner or cylinder ends of the hydraulic or pneumatic cylinders are affixed to a cross beam 60 of the trailer frame. Actuation of the cylinders 56 will cause the pontoon supports to either move toward one another to the position shown in FIGS. 2 and 6 or away from one another to the positions shown in FIGS. 1 and 5. The configuration of the collapsible boat shown in FIG. 1 and 5 is the configuration assumed by the boat when it is in use on the water. The configuration of FIGS. 2 and 6 is that assumed when the boat is being trailed or put into storage. It will be appreciated that it may be too wide to be pulled on roads and highways. Narrowing of the boat to the configuration wherein the pontoons are closely adjacent to one another as shown in FIGS. 2 and 6 will enable the boat to be hauled safely and legally.

Actuation of the cylinders 56 to retract the shafts thereof will, as indicated above, cause the pontoon supports 50 and the pontoons 20 supported thereby to move toward one another. The boat and trailer incorporate structure which will result in the center deck panels 12, 14 moving to their vertical orientations when such movement takes place.

Part of that structure is in the form of gas (such as air) biased pistons 62 which project upwardly from a plurality of cylinders 64 affixed to trailer frame 32 at spaced locations thereon and located along the center of the trailer frame. The air or other gas in the cylinder 64 is constantly maintained under pressure so that the pistons 62 associated therewith are always urged outwardly.

Figure 7:
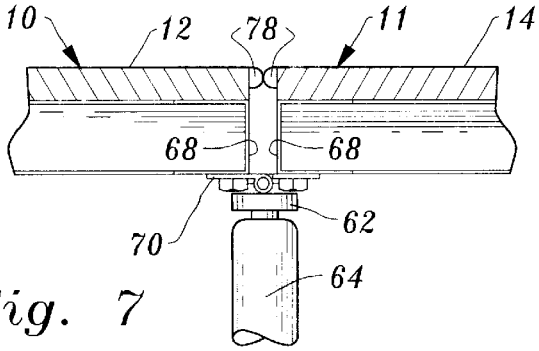
FIG. 7 is a sectional view showing portions of center deck panels of the boat along with hinge structure and a biasing piston operatively associated therewith, the center deck panels being disposed in a horizontal plane.

When the collapsible boat 64 is located on the trailer and the pontoons and pontoon supports are positioned so that the boat is in its wide or extended configuration the piston 62 will be located under the inner adjacent portions of center deck panels 14, 16, the downward forces exerted by the center deck panels on the pistons 62 being sufficient to move them to their retracted positions shown in FIG. 7. That is, the air pressure within cylinders 64 is not of sufficient magnitude to prevent the center deck panels from assuming their horizontal positions when the collapsible boat is extended.

The center deck panels 12, 14 have side walls 68 which are spaced from one another and define a gap therebetween when the center deck panels are at their horizontal orientations as shown in FIG. 7. Center deck panels 12, 14 are pivotally connected by hinges 70 which bridge the gap between the side walls 68. The hinges 70 are affixed to the bottom of the center deck panels at a plurality of spaced locations along the center deck panels; however, in the interest of simplicity, only one such hinge 70 is illustrated. See FIGS. 7, 8 and 9.

Opposed pivoted ends of each hinge 70 define slots 72. Bolts or other mechanical fasteners 74 pass through the slots 72 and secure the hinges to the center deck panels in a fashion that will allow the hinges to slide or move relative to the center deck panels and bolts as indicated by the double-headed arrows in FIG. 9.

Abutment members 78 extend inwardly from the center deck panels and are in contact when the center deck panels are horizontal to maintain the panels in position relative to one another to form the above-described gap.

Figure 8:
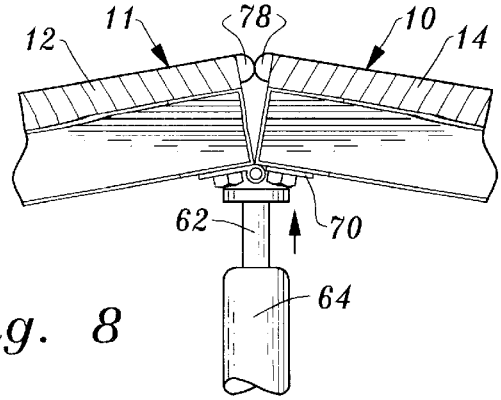
FIG. 8 is a view similar to FIG. 7 but showing the center deck panels being pivoted upwardly as they progress toward vertical orientations.

The gap between the center deck panels and the floating hinge construction are quite important since they permit the outer deck panels to move toward one another without the center deck panels binding together to jam up or interfere with the operation of moving the center deck panels to a vertical orientation. It is appreciated that if the side walls 68 were in an abutting engagement when the process started, the center deck panels would not have sufficient clearance to pivot relative to one another as shown in FIG. 8 during the initial stage of the operation which brings the center deck panels to a vertical orientation. The abutting center deck panel ends would in fact cause the overall deck width to increase during the initial stage of pivotal movement without the existence of the gap.

Figure 4:
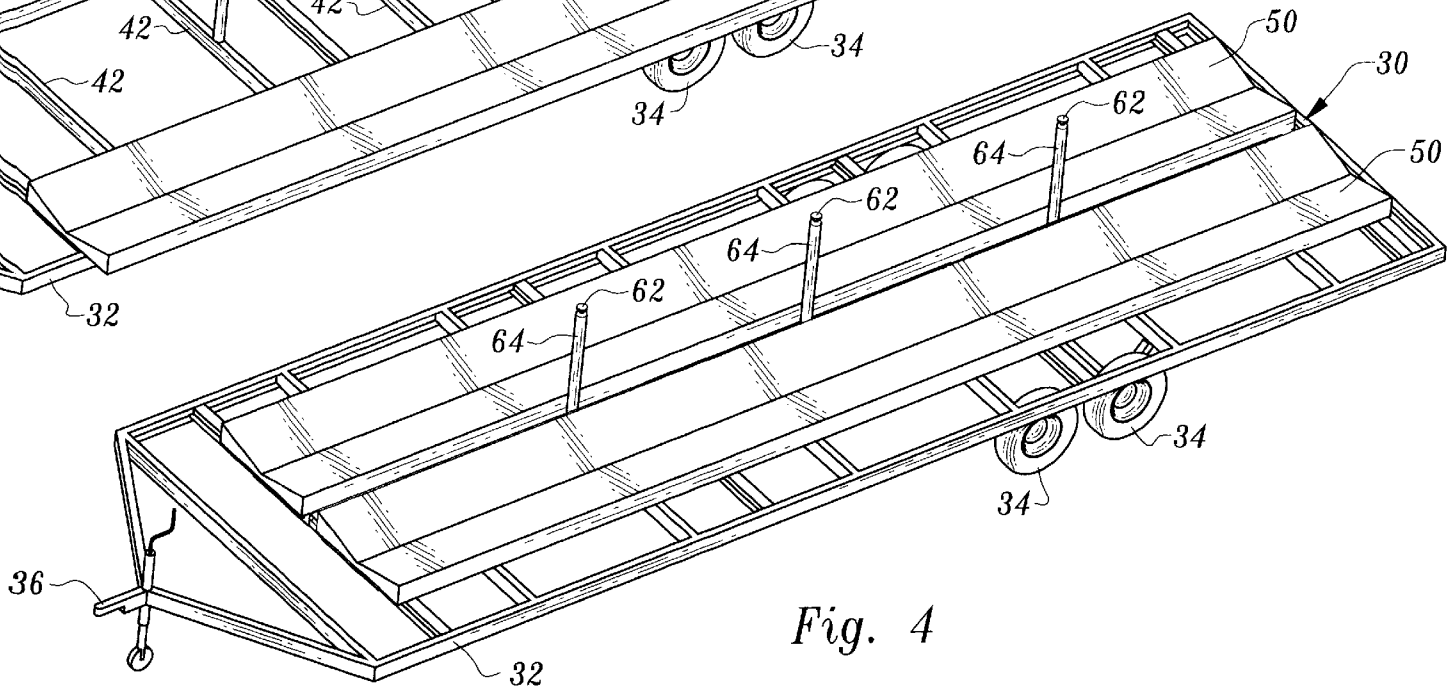
FIG. 4 is a view similar to FIG. 3, but illustrating the pontoon supports in close proximity to one another.

The upward bias of gas biased piston 62 urges the adjacent ends of the center deck panels upwardly as inward movement of the outer deck panels takes place due to movement of the pontoon supports and pontoons toward one another. It will be appreciated that the downward force exerted by the ends of the center deck panels on the pistons 62 lessens after movement of the outer deck panels toward one another commences. When the pontoon supports are in the positions shown in FIGS. 2, 4 and 6 there will be sufficient clearance therebetween to accommodate the upstanding cylinders 64.

What is claimed is:

1. In combination:

a collapsible boat having first and second alternative configurations, said collapsible boat being wider in said first configuration than in said second configuration and including first and second pontoons selectively movable toward or away from one another, said first and second pontoons being further apart when said collapsible boat is in said first configuration than when said collapsible boat is in said second configuration;

a transport vehicle for receiving said collapsible boat and for supporting and transporting said collapsible boat on land when said collapsible boat is not afloat, said collapsible boat being completely separable from said transport vehicle whereby said collapsible boat may be placed afloat completely separate from said transport vehicle, said transport vehicle including first and second pontoon supports for respectively removably receiving, accommodating and supporting said first and second pontoons when said transport vehicle supports said collapsible boat; and mover means for causing relative movement between said pontoon selectively toward or away from one another, supports and causing simultaneous relative movement between said pontoons accommodated and supported thereby selectively toward or away from one another selectively toward or away from one another.

2. The combination according to claim 1 wherein said mover includes a boat deck comprising a plurality of boat deck panels including first and second center deck panels disposed side-by-side and first and second outer deck panels, said first outer deck panel being disposed alongside said first center deck panel and said first center deck panel being positioned between said second center deck panel and said first outer deck panel, said second outer deck panel being disposed alongside said second center deck panel and said second center deck panel being positioned between said first center deck panel and said second outer deck panel, said first and second center deck panels moving from a substantially horizontal orientation to a substantially vertical orientation when said boat collapsing means changes the configuration of said collapsible boat from said first configuration to said second configuration.

3. The combination according to claim 2 wherein said pontoons are attached to said first and second outer deck panels.

4. The combination according to claim 2 wherein said collapsible boat additionally comprises hinge means interconnecting said plurality of boat deck panels.

5. The combination according to claim 2 wherein said first outer deck panel is pivotally connected to said first center deck panel and wherein said second outer deck panel is pivotally connected to said second center deck panel.

6. The collapsible boat according to claim 5 wherein said first and second center deck panels are pivotally interconnected.

7. The combination according to claim 2 wherein said first and second center deck panels have adjacent distal side walls spaced from one another and defining a gap therebetween, said collapsible boat additionally comprising hinge means pivotally interconnecting said first and second center deck panels and extending across said gap.

8. The combination according to claim 7 additionally comprising abutment members projecting from said distal side walls and extending across said gap, said abutment members being spaced from said hinge means.

9. The combination according to claim 7 wherein said hinge means is slidably mounted on at least one of said first and second center deck panels.

10. The combination according to claim 7 wherein said hinge means is slidably mounted on said first and second center deck panels.

11. The combination according to claim 2 wherein said transport vehicle additionally comprises panel biasing means for exerting an upwardly directed bias on said first and second center deck panels when said first and second center deck panels are in a substantially horizontal orientation to promote pivotal movement of said first and second center deck panels relative to said first and second outer deck panels when said mover means changes the configuration of said collapsible boat from said first configuration to said second configuration.

12. The combination according to claim 11 wherein said panel biasing means includes at least one fluid biased piston engaging bottoms of said first and second center deck panels.

13. The combination according to claim 2 wherein said mover means comprises at least one movable piston connected to at least one of said pontoon supports.

14. The combination according to claim 2 wherein said boat collapsing means wherein said boat collapsing means additionally comprising guide means for guiding movement of at least one of said pontoon supports.

15. In combination:

a collapsible boat including a boat deck comprising a plurality of boat deck panels including first and second center deck panels disposed side-by-side and first and second outer deck panels, said first outer deck panel being disposed alongside said first center deck panel and said first center deck panel being positioned between said second center deck panel and said first outer deck panel, said second outer deck panel being disposed alongside said second center deck panel and said second center deck panel being positioned between said first center deck panel and said second outer deck panel, said collapsible boat additionally including pontoons connected to said first and second outer deck panels;

a transport vehicle for supporting and transporting said collapsible boat on land and including panel mover means for moving said first and second outer deck panels of said collapsible boat relative to one another, said first and second center deck panels of said collapsible boat moving from a substantially horizontal orientation to a substantially vertical orientation when said mover means causes said first and second outer deck panels to move toward one another to reduce the width of said boat deck, said transport vehicle and said collapsible boat being completely separable from one another whereby said collapsible boat may be placed afloat completely separate from said transport vehicle, said transport vehicle including relatively movable pontoon supports for receiving and supporting the pontoons of said collapsible boat when said collapsible boat is being transported by said transport vehicle on land, said mover means causing relative movement between for said pontoon supports selectively toward or away from one another, and causing simultaneous relative movement between said pontoons supported thereby "selectively toward or away from one another" selectively toward or away from one another when said transport vehicle supports said collapsible boat.

16. The combination according to claim 15 wherein said collapsible boat additionally comprises hinge means interconnecting said plurality of boat deck panels.

17. The combination according to claim 15 wherein said first outer deck panel is pivotally connected to said first center deck panel and wherein said second outer deck panel is pivotally connected to said second center deck panel.

18. The combination according to claim 17 wherein said first and second center deck panels are pivotally interconnected.

19. A transport vehicle employed in combination with collapsible boat for transporting collapsible boat, said boat having first and second alternative configurations, said collapsible boat having movable deck panels and being wider in said first configuration than in said second configuration, said transport vehicle including boat collapsing means engageable with said collapsible boat to change the configuration of said collapsible boat from said first configuration to said second configuration when said transport vehicle supports said collapsible boat and additionally including panel biasing means for exerting an upwardly directed bias on at least one panel of the movable deck panels of said collapsible boat to facilitate change of the configuration of said collapsible boat from said first configuration to said second configuration.

20. The transport vehicle of claim 19 wherein said boat collapsing means includes a plurality of movable pontoon supports for accommodating and supporting pontoons of said collapsible boat and pontoon support mover means for moving at least one of said pontoon supports toward another of said pontoon supports.

21. The transport vehicle of claim 19 wherein said panel biasing means includes at least one fluid biased piston.

* * * * *

UNITED STATES PATENT AND TRADEMARK OFFICE

CERTIFICATE OF CORRECTION

PATENT NO. : 6,298,802 B1
DATED : October 9, 2001
INVENTOR(S) : James Brignolio

It is certified that error appears in the above-identified patent and that said Letters Patent is hereby corrected as shown below:

Column 5,
Line 17, insert -- supports -- after “pontoon”.
Line 18, delete “supports”.
Lines 20 and 21, delete “selectively toward or away from one another selectively toward or away from one another”
Line 35, thereof, delete “boat collapsing” and substitute -- mover -- therefor.

Column 6,
Line 13, delete “mover” and substitute -- collapsible boat -- therefor.
Lines 13 and 16, change “2” to -- 1 --.
Line 17, delete “wherein said boat collapsing means”.
Line 18, change “comprising” to -- comprises --
Line 36, delete “panel”.
Line 53, add -- for -- after “means” and delete “for” after “between”.
Lines 56-58, delete ““selectively toward or away from one another” selectively toward or away from one another”.

Column 7,
Line 1, insert -- a -- after “with”.
Line 2, insert -- said -- after “transporting”.

Signed and Sealed this

Thirteenth Day of August, 2002

*Attest:*

*Attesting Officer*

JAMES E. ROGAN
*Director of the United States Patent and Trademark Office*